US007232125B2

(12) United States Patent
Richter et al.

(10) Patent No.: US 7,232,125 B2
(45) Date of Patent: Jun. 19, 2007

(54) DEVICE FOR COLLATING LAMINAR WORKPIECES

(75) Inventors: Lutz Richter, Schkeuditz (DE); Andreas Steinert, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/177,219

(22) Filed: Jul. 7, 2005

(65) Prior Publication Data

US 2006/0027960 A1 Feb. 9, 2006

(30) Foreign Application Priority Data

Aug. 5, 2004 (DE) ..... 10 2004 037 896

(51) Int. Cl.
*B65H 1/22* (2006.01)

(52) U.S. Cl. ..... 271/151; 270/58.08; 270/52.26; 270/52.29

(58) Field of Classification Search ..... 270/58.08, 270/52.26, 52.29; 271/151
See application file for complete search history.

(56) References Cited

U.S. PATENT DOCUMENTS

| | | | | |
|---|---|---|---|---|
| 3,972,521 | A | 8/1976 | Reed | |
| 4,436,297 | A * | 3/1984 | Chandhoke | 271/3.05 |
| 4,903,600 | A * | 2/1990 | Long | 101/485 |
| 5,013,019 | A * | 5/1991 | Samuels | 270/1.02 |
| 5,326,087 | A | 7/1994 | Colson et al. | |
| 6,082,724 | A | 7/2000 | Kahlig et al. | |
| 6,393,251 | B2 * | 5/2002 | Kono | 399/370 |
| 6,832,758 | B2 | 12/2004 | Richter et al. | |
| 2003/0151188 | A1 * | 8/2003 | Imahara | 271/171 |
| 2004/0156666 | A1 * | 8/2004 | Ouchi et al. | 400/708 |

FOREIGN PATENT DOCUMENTS

| | | |
|---|---|---|
| DE | 25 43 056 | 9/1976 |
| DE | 198 22 438 | 2/1999 |
| DE | 197 52 015 A1 | 5/1999 |
| DE | 197 56 539 C1 | 8/1999 |
| DE | 199 31 748 A1 | 2/2000 |
| EP | 0 727 379 A2 | 8/1996 |
| EP | 917965 A1 * | 5/1999 |
| JP | 04-269594 | 9/1992 |
| JP | 11-115342 | 4/1999 |

OTHER PUBLICATIONS

Official Communication dated Dec. 1, 2005, issued in the corresponding German Patent Application No. 05106916.9-2314. (With full English translation).

* cited by examiner

*Primary Examiner*—Gene O. Crawford
*Assistant Examiner*—Leslie A. Nicholson, III
(74) *Attorney, Agent, or Firm*—Keating & Bennett, LLP

(57) ABSTRACT

A device for the assembly of brochures from folded sheets includes a continuous conveyor which defines a direction of conveyance, feeders which deliver the folded sheets to the continuous conveyor, and controls for controlling the operation of the feeders and the continuous conveyor. In order to avoid waste and operational malfunctions, the controls provide the feeders located downstream from a first feeder with a law of motion which is dependent on the format of the folded sheets.

9 Claims, 4 Drawing Sheets

DEVICE FOR COLLATING LAMINAR WORKPIECES

BACKGROUND OF THE INVENTION

1. Field of the Invention

The present invention relates to a device for collating laminar workpieces with a continuous conveyor which determines a direction of conveyance, feeders which deliver the workpieces to the continuous conveyor for the assembly of brochures, and with controls for the operation of the feeders and the continuous conveyor.

2. Description of the Related Art

A conventional device of this type includes a component of a saddle stitcher as disclosed, for example, in DE 197 52 015 A1. The saddle stitcher disclosed therein for the assembly of stitched brochures from folded sheets includes individual driving units, one of which is respectively allocated to a stitching station, to each feeder, and to a continuous conveyor in the form of a saddle chain. This provides exceedingly flexible operation of the saddle stitcher in which the controls provided therein adjust, particularly, the phasing of the feeders in relation to the saddle chain to a respective new spine length when the spine length of the folded sheets is changed due to a change in task.

While a saddle stitcher designed in such a manner can process folded sheets in portrait format without problems and at a respectable rate of productivity, problems arise particularly with folded sheets in landscape format if no further measures are taken, insofar as folded sheets of a respective brochure following one another do not come to lie on top of one another after shingling, but rather abut at their top sides, and at their bottom sides, which leads to faulty production and malfunctions.

SUMMARY OF THE INVENTION

To overcome the problems described above, preferred embodiments of the present invention provide a device which enables the assembly of brochures in landscape format without waste and without operational malfunctions.

According to a preferred embodiment of the present invention, controls are provided which impose a law of motion (algorithm) upon each respective feeder which is dependent on the format of the workpieces.

In the case of a continuous conveyor which includes a ridge which carries folded sheets thereon and sloping conveying in the form of a pitched roof extending from the continuous conveyor, the laws of motion (algorithms) are designed such that the edges of the open ends of the folded sheets reach the level of the ridge only after the preceding edge of the already delivered folded sheet has already passed the lagging edge of the subsequently passing folded sheet of the respective brochure, such that by the time this state is reached, folded sheets of the respective brochure which follow one another are spaced apart.

Other features, elements, steps, characteristics and advantages of the present invention will become more apparent from the following detailed description of preferred embodiments with reference to the attached drawings.

DETAILED DESCRIPTION OF PREFERRED EMBODIMENTS

Figure 1:
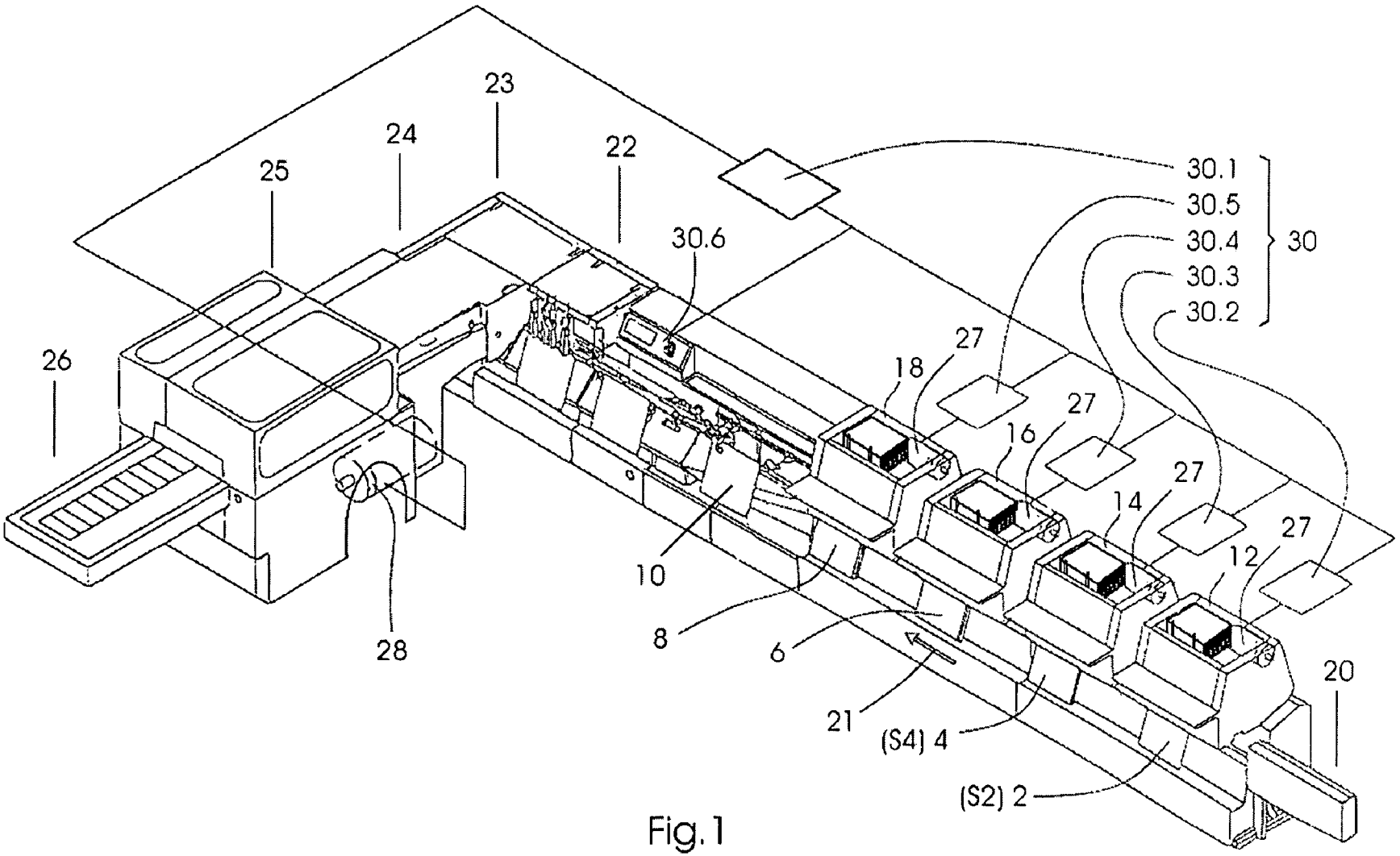
FIG. 1 shows, a saddle stitcher including controls, a continuous conveyor including a drive mechanism, and feeders.

The saddle stitcher shown in FIG. 1 preferably includes four feeders 12, 14, 16, and 18 and a continuous conveyor 20 including a continuously running saddle chain (not shown in detail) with a direction of conveyance corresponding to the arrow 21 in FIG. 1.

A first feeder 12 delivers a folded sheet 2, separated from a stack, respectively to locations following one after the other on the continuous conveyor 20. A further feeder 14, located downstream from the feeder 12 with respect to the direction of conveyance, deposits a folded sheet 4 on the respective folded sheet 2, conveyed by the continuous conveyor 20 in the direction of conveyance. In a similar manner, the feeder 16 deposits a respective folded sheet 6 on the respectively deposited folded sheet 4, and the feeder 18 deposits a respective folded sheet 8 on the respectively deposited folded sheet 8, such that a brochure 10 is created whose number of pages can be determined from the number of folds in folded sheets 2, 4, 6, and 8. This brochure 10 is fed by the continuous conveyor 20 to a stitching device 22, and finally to an output station 23.

Adjacent to the output station 23 is a trimmer feeder 24 which feeds the brochures 10 by a conveyor belt system to the trimmer 25, which trims the brochures 10 on the edge opposite the stitched spine as well as on the top and bottom of the brochure 10, and then feeds them to a delivery tray 26.

Of the machine components described thus far, the feeders 12, 14, 16, and 18 and the continuous conveyor 20 define the mechanical portion of the device for collating laminar workpieces—here in the form of the folded sheets 2, 4, 6, and 8 piled up into a respective stack in the respective feeders 12, 14, 16, and 18.

As an alternative to the continuous conveyor 20 extending into the output station, a continuous conveyor 20 may also be provided which ends before the stitching device 22 and delivers the brochures 10 to an oscillating finger guide system, which conveys the brochures 10 step by step. The oscillating finger guide system is disposed next to a stitching station in which the brochures are stitched and feeds the brochures to an output station, from which point they are, in turn, fed to the trimmer 25, for example. Each of the different continuous conveyors includes carriers 20' arranged at regular intervals which push the folded sheets or brochures from them.

Regardless of which conveyor and stitching systems are used, the individual machine components must be adjusted with respect to their reciprocal phasing when the format of the brochures 10 is changed due to a change in task. If the mutual spacing of the feeders 12, 14, 16, and 18 corresponds to the mutual spacing of the aforementioned carriers 20', or an integral plurality of the feeders 12, 14, 16, and 18 mutually correspond, the feeders 12, 14, 16, and 18 can be operated by a common driving mechanism. Otherwise, as shown in FIG. 1, a separate driving mechanism 27 must be provided for each of the feeders 12, 14, 16, and 18 and their respective phasing individually must be adjusted to the continuous conveyor 20 according to the length of the spine of the brochures 10. Prior art reference number DE 102 004 021 958.3 describes the individual adjustment of the respective phasing. The driving mechanisms 27 of the feeders 12, 14, 16, and 18 are preferably defined by servo drives.

The continuous conveyor 20 is operated using at least one additional driving mechanism 28, which, as an example, also drives the stitching device 22, the trimmer feeder 24, and the trimmer 25, or alternatively, is designed exclusively for the operation of the continuous conveyor 20, and is preferably defined by a positionally controlled driving mechanism, that is, as a servo drive.

Figure 2:
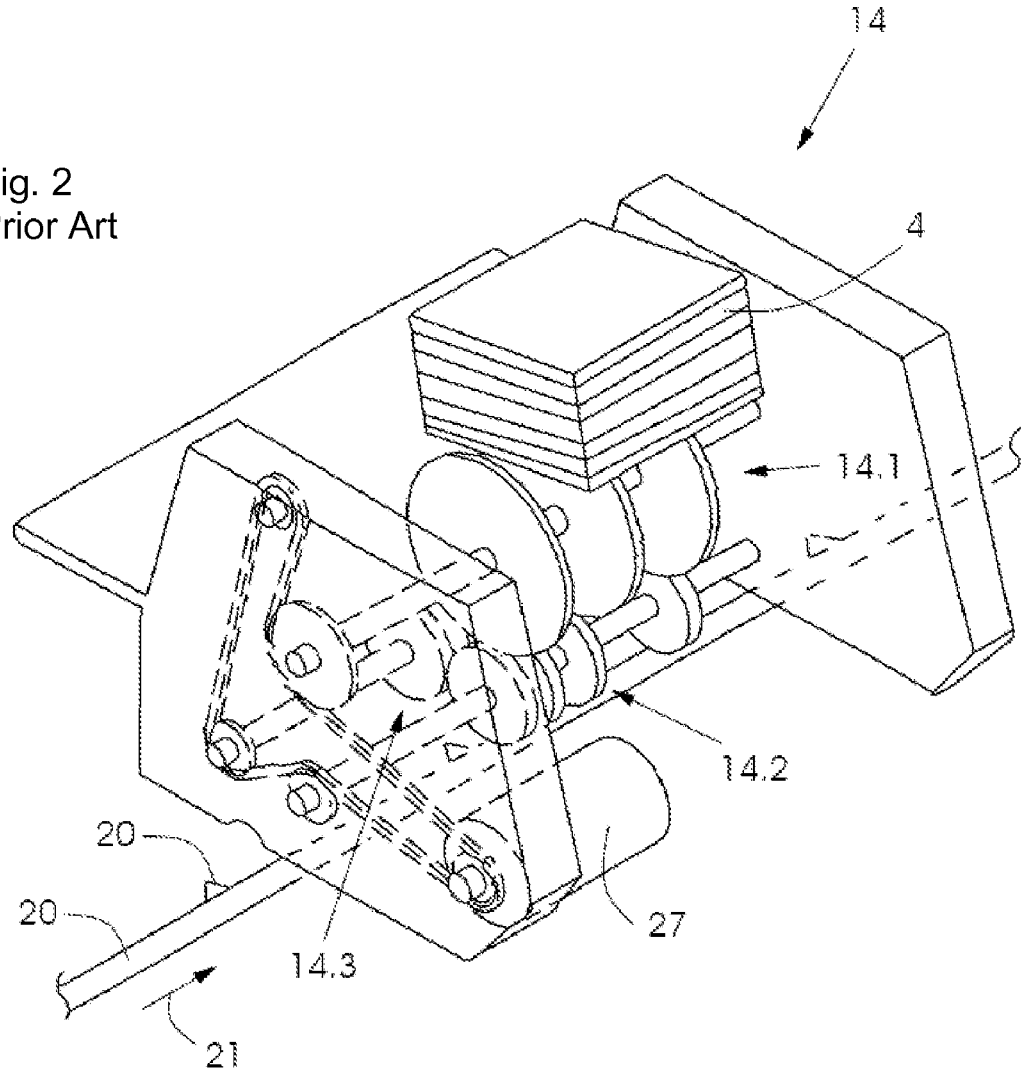
Fig. 2 Prior Art
FIG. 2 shows a feeder of the saddle stitcher with a simplified illustration particularly of a separating drum and opening drums.

FIG. 2 shows in simplified illustration of some details of one of the feeders 12, 14, 16, and 18 and its correlation to the continuous conveyor 20, represented here only symbolically, with carriers 20'arranged alongside it. The feeder 14 is shown with a supply of stacked folded sheets 4 in the feeder 14. The feeder 14 transports the sheets in accordance with the format of the folded sheets and according to various laws of motion (algorithms) in the direction of the continuous conveyor 20. FIG. 2 shows the driving mechanism 27, a separating drum 14.1 and opening drums 14.2 and 14.3. The operation of the separating drum 14.1 and the opening drums 14.2 and 14.3 by the driving mechanisms 27, preferably defined by servo drives, is performed, for example, via a common chain or belt drive.

A drive control 30.1 is provided for the driving mechanism 28 according to the present preferred embodiment for the operation of the continuous conveyor 20, stitching device 22, trimmer feeder 24, and the trimmer 25. Together with the feeder controls 30.2 to 30.5, to which the respective driving mechanisms 27 of the feeders 12, 14, 16, and 18 are provided, the drive control 30.1 defines the controls 30 for the operation of the entire saddle stitcher.

In addition to the central controls, decentralized control units are provided in the present preferred embodiment. The decentralized control units are connected with one another and with a central control-section 30.6 via a bus. The decentralized control units are capable of exchanging information about the respective phasing of the driving mechanisms 27 and 28 and, using an appropriate control logic, linking the decentralized control units with electronically stored or storable information about the formats of the brochures to be created such that, when processing folded sheets of a certain format, the feeders 12, 14,16, and 18, controlled by their driving mechanisms via the feeder controls 30.2 to 30.5, deliver the folded sheets to the continuous conveyor 20 using the law of motion (algorithm) allocated to the respective format. In addition, electronic information stored in the controls 30 preferably includes the format-dependant laws of motion (algorithms).

Figure 3:
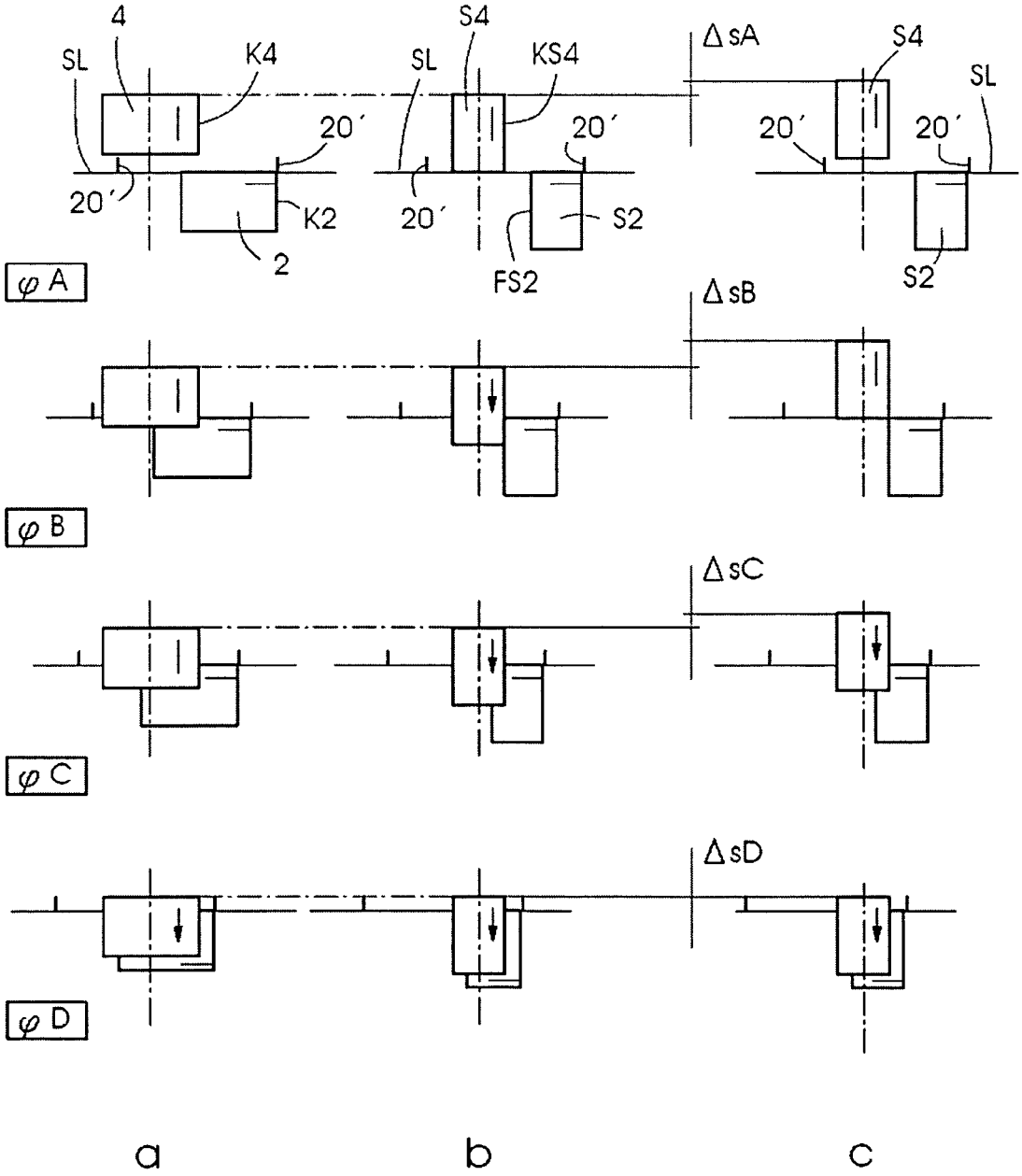
FIG. 3 shows folded sheets of various formats which follow one after the other according to certain laws of motion as snapshots at various angles of rotation of the driving mechanism allocated to the continuous conveyor.

FIG. 3 shows snapshots of the delivery of folded sheets of different formats from the feeder 14 to the continuous conveyor 20, represented by a saddle line SL which is adjacent to the fold of the folded sheets 2, 4, 6, 8. The folded sheets are shown in portrait format in column a of FIG. 3; the folded sheet which has already been deposited on the saddle line SL (see FIG. 1) and the folded sheet 4 following it (see FIG. 1) are shown. The snapshots in column a of FIG. 3—as well as those of columns b and c—show the conditions at the time of a first rotation angle $\phi A$ of the driving mechanism 28 provided in each case for the operation of the continuous conveyor 20, as well as at increasingly larger rotation angles $\phi B$, $\phi C$, $\phi D$.

According to the law of motion (algorithm) provided in column a of FIG. 3, the folded sheet 4 approaches the already deposited folded sheet 2 at a constant speed and reaches it, at the latest, when the carrier 20', active on the top side K2 of the folded sheet 2, overlaps the top side K4 of the folded sheet 4. This is accomplished by the adjustment of the reciprocal phasing of the driving mechanism 27 of the feeder 14 and the adjustment of the reciprocal phasing of the driving mechanism 28, which drives the continuous conveyor 20, and by the uniform rotation of the separating drum and opening drums 14.1, 14.2, and 14.3 of the feeder 14.

Column b of FIG. 3 shows folded sheets S2 and S4 in landscape format. Here again, the law of motion (algorithm) according to column a of FIG. 3 is provided. However, in order to adjust the process of delivering the folded sheets to the shortened spine length (in comparison to column a), the reciprocal phasing of the driving mechanism 27 of the feeder 14 and the reciprocal phasing of the driving mechanism 28, which drives the continuous conveyor 20, is adjusted to the requirements of the shortened spine length and the width of the folded sheets.

As is clear from the snapshot in column b of FIG. 3 at rotation angle $\phi B$ of the driving mechanism 28, collisions may occur depending upon the spine lengths and widths of the folded sheets, such that a bottom side FS2 of an already delivered folded sheet S2 in landscape format collides with the lagging top side KS4 of a subsequently passing folded sheet S4 in landscape format.

This problem, which occurs with short spine lengths and/or long bottom and top sides of the folded sheets, is preventing by adjusting, by means of controls 30, laws of motion (algoritms) which are dependent on the format of the folded sheets on the separating drum and opening drums 14.1, 14.2, and 14.3 and the corresponding drums of the feeders disposed downstream—here, feeders 16 and 18.

In the preferred embodiment shown in column c of FIG. 3, including folded sheets S2 and S4 of the same format as shown in column b of FIG. 3, a corresponding law of motion (algorithm) provides for a deceleration, at first increasing and subsequently decreasing again to zero, of the fold of the following folded sheet S4 compared to the path which the fold of the folded sheet 4 takes at uniform delivery speed according to column b of FIG. 3.

In the preferred embodiment, a deceleration $\Delta sA$ results from the mutually opposing paths of motion within a delivery cycle for a folded sheet according to columns b and c of FIG. 3 at rotation angle $\phi A$, and an increased deceleration $\Delta sB$ compared to $\Delta sA$ results at rotation angle $\phi B$. This decreases to $\Delta sC$ when rotation angle $\phi C$ is reached, and continues to decrease to $\Delta D$, which is approximately zero, at rotation angle $\phi D$. The deceleration $\Delta sB$ is critical to a collision-free delivery of the folded sheets. The controls 30 calculate the deceleration $\Delta sB$ based on the spine length and width of the folded sheets and from known parameters which are dependent on the layout design of the saddle stitcher, e.g., path of conveyance of the continuous conveyor 20 during a machine cycle, path of conveyance of the feeder per machine cycle, and duration of a machine cycle. In a subsequent step of these calculations, the controls 30 select a suitable law of motion (algorithm) from a plurality of laws of motion (algorithms) stored in memory and apply the suitable law of motion (algorithm) to the driving of the respective feeder.

Alternatively, a suitable law of motion (algorithm) may be selected using parameterization of a function stored in the controls and applied to the appropriate driving mechanisms.

The formats of the folded sheets can be communicated to the controls by manual input or automatically by suitable sensors.

Figure 4:
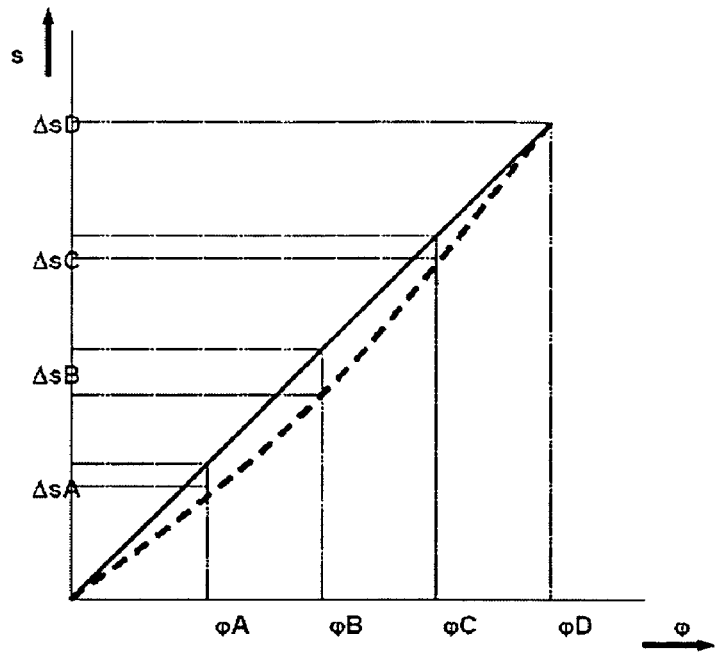
FIG. 4 shows a diagram of various laws of motion which illustrates the respective path within the cycle of a feeder taken by a folding sheet depending on the rotation angle of the driving mechanism of the continuous conveyor.

FIG. 4 illustrates the deceleration indicated in column c of FIG. 3 at selected points on a graph which shows, with a broken line, the law of motion (algorithm) during a complete delivery cycle along the path s of the folded sheet 4 against the rotation angle $\phi$of the driving mechanism 28, which drives the continuous conveyor 20, and contrasts it with a uniform motion of the folded sheets during assembly into brochures 10, represented by a solid line. The law of motion (algorithm) represented by a broken line represents one of a plurality of laws of motion (algorithms).

The respective deceleration $\Delta sA$, $\Delta sB$, $\Delta sC$, and $\Delta sD$ results from a comparison of the two lines at the already mentioned rotation angles $\phi A$, $\phi B$, $\phi C$, and $\phi D$ of the driving mechanism 28.

Figure 5:
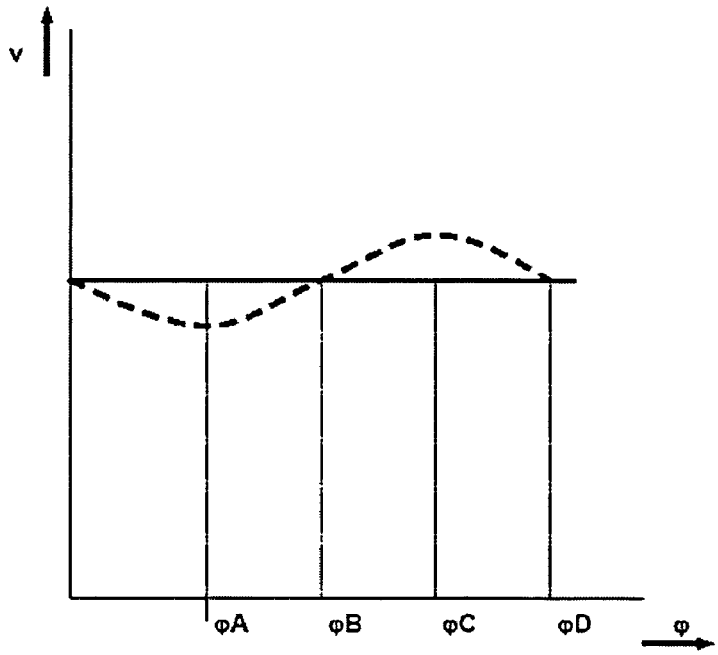
FIG. 5 shows a diagram of various laws of motion which illustrates the respective speed of a folding sheet within the cycle of a feeder depending on the rotation angle of the driving mechanism of the continuous conveyor.

In FIG. 5, the laws of motion (algorithms) depicted in FIG. 4 are illustrated using another form of representation, namely in the form of delivery speed v as a function of the rotation angle $\phi$of the driving mechanism 28.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A device for collating laminar workpieces comprising:

a continuous conveyor defining a direction of conveyance;

a plurality of feeders which deliver the workpieces to the continuous conveyor for the assembly of brochures; and controls for operating the feeders and the continuous conveyor; wherein the controls provide the feeders of the plurality of feeders located downstream from a first feeder of the plurality of feeders with a respective one of a plurality of algorithms, which is used by the controls to determine rotational speed of feeder drums of the feeders, wherein the determined rotational speed of the feeder drums of the feeders is dependent upon the format of the workpieces, and is determined by a spine length and a spine width of the workpieces.

2. The device according to claim 1, wherein the respective algorithm is defined such that workpieces of a respective brochure following one after another are spaced apart from each other at least until a preceding edge of a first workpiece delivered to the continuous conveyor has passed a subsequently passing edge of a second workpiece to be added to the first.

3. The device according to claim 1, wherein the respective algorithm provides varying degrees of deceleration of the feeders of the plurality of feeders located downstream from the first feeder depending which are determined based on a spine length and a width of the workpieces.

4. The device according to claim 1, wherein each of the plurality of feeders comprises a driving mechanism, a separating drum and opening drums.

5. A saddle stitcher comprising the device for collating laminar workpieces according to claim 1.

6. A method of collating laminar workpieces comprising the steps of:

providing a continuous conveyor which a direction of conveyance;

providing a plurality of feeders for delivering the workpieces to the continuous conveyor for the assembly of brochures;

providing controls for operating the feeders and the continuous conveyor; and providing from the controls to the feeders of the plurality of feeders located downstream from a first feeder of the plurality of feeders a respective one of a plurality of algorithm which is used by the controls to determine rotational speed of feeder drums of the feeders, wherein the determined rotational speed of the feeder drums of the feeders is dependent upon the format of the workpieces, and is determined by a spine length and a spine width of the workpieces.

7. The method according to claim 6, wherein the respective algorithm is defined such that workpieces of a respective brochure following one after the other are spaced apart from each other at least until a preceding edge of a first workpiece delivered to the continuous conveyor has passed a subsequently passing edge of a second workpiece to be added to the first.

8. The method according to claim 6, wherein the respective algorithm provides varying degrees of deceleration of the feeders of the plurality of feeders located downstream from the first feeder depending which are determined based on a spine length and a width of the workpieces.

9. The method according to claim 6, wherein each of the plurality of feeders comprises a driving mechanism, a separating drum and opening drums.

* * * * *